United States Patent [19]

Galli et al.

[11] 4,011,943

[45] Mar. 15, 1977

[54] TRANSPORTATION AND DISPLAY CASE FOR HOLDING SMALL ARTICLES SUCH AS PRALINES

[75] Inventors: Giordano Galli, Neu Isenburg; Inge Hansen, Frankfurt am Main; Friedrich Reichert, Steinbach, all of Germany

[73] Assignee: Ferrero GmbH, Frankfurt am Main, Germany

[22] Filed: Jan. 14, 1976

[21] Appl. No.: 649,003

[30] Foreign Application Priority Data

Jan. 22, 1975 Germany ..... 2502502

[52] U.S. Cl. ..... 206/44 R; 206/45; 211/128

[51] Int. Cl.[2] ..... B65D 5/50; B65D 5/52

[58] Field of Search ..... 206/44 R, 45; 190/17; 211/128

[56] References Cited

UNITED STATES PATENTS

| | | | |
|---|---|---|---|
| 841,535 | 1/1907 | Kelley | 206/45 |
| 1,916,227 | 7/1933 | Lorenzen | 206/44 R |
| 2,110,934 | 3/1938 | Kanty | 206/45 |

*Primary Examiner*—George T. Hall

*Attorney, Agent, or Firm*—Sughrue, Rothwell, Mion, Zinn & Macpeak

[57] ABSTRACT

A transportation and display case for holding individual small articles of a plurality of levels is comprised of a container having a rear wall and a bottom wall at right angles to each other joined by side walls having a substantially triangular configuration. A pair of zig-zag shaped strips are foldable out of the rear wall to provide support for the rear edges of a plurality of superimposed trays in an incline overlapping relation. Tabs are provided on the lower sides of each tray adjacent the front thereof for insertion into slots in the upper sides of each tray adjacent the rear thereof to hold the trays in staggered relation to each other.

14 Claims, 5 Drawing Figures

TRANSPORTATION AND DISPLAY CASE FOR HOLDING SMALL ARTICLES SUCH AS PRALINES

BACKGROUND OF THE INVENTION

1. Field of the Invention

The present invention relates to a transportation and display case for holding a plurality of individual small articles such as pralines which are stored on a plurality of levels.

2. Description of the Prior Art

Numerous forms of containers for holding individual small articles such as pralines are already known. Individual small articles of this type are not only stored in boxes but also in containers of different forms. However, these individual small articles are not generally sold individually as the packaging costs and time required to unpack the small articles, for example, in discount stores or supermarkets, are too high.

SUMMARY OF THE INVENTION

The object of the present invention is to provide a container, more particularly, a large container, from which individual small articles such as pralines can be sold least expensively.

This is achieved in the case of a transportation and display case of the type described initially in that the individual small articles are arranged adjacent to one another ready for removal in ascending trays; the trays comprising at their upper and lower sides connecting parts which are staggered with respect to one another and adapted to be brought into engagement with one another and the rear wall of the container comprising mounting suppots providing the individual trays with an inclined position.

Items such as fruit are often sold on trays which are stacked one above the other but the trays are not arranged in a container. In this connection it should also be noted that large containers, for example, for packets of pralines, are already known which can be converted from the transporting position into the retail position with very little difficulty. These are the so-called floor stands.

The special arrangement of the individual small articles on the inclined trays also makes it especially simple for the retailer to mark the prices on the articles.

According to a preferred embodiment of the invention the tray holders consist of zig-zag shaped strips or the like which are pivotable from the rear wall towards the inside of the container.

The connecting parts advantageously consist of flaps, pins, or the like provided on the underside at the front part of the side wall sections and of slots, openings, or the like provided on the upper side at the rear part of the side wall sections — or vice-versa. Thus, each tray already comprises the requisite connecting means for producing a multi-layer, inclined assembly.

The flaps or the like can be folded against the bottom wall of the trays.

A modified embodiment of the invention consists in that the upper wall of the container can be folded back into the plane of the rear wall in a known manner; the front wall, or at least the larger part thereof, can be hinged to the upper wall and displaced jointly with the latter.

The upper edges of the side walls of the container preferably enclose an acute angle with respect to the bottom wall.

In the transporting position the container can be covered with a slide-on lid extending to the bottom wall. In this way, the display case, which may comprise an inclined upper wall and an inclined front wall, can be converted into a rectangular, and thus easily stowable container, simply by slipping on the lid. The display case can be made ready for use simply by removing the slide-on lid and swinging away the upper wall of the container.

As stated, the slide-on lid is preferably rectangular in shape. The slide-on lid and possibly the container may advantageously be provided with openings to enable staff to handle the conatiner. According to a preferred embodiment of the invention the trays are provided with grooves, longitudinal slots, or the like to enable the individual small articles to slide more easily.

An insert can also be provided on the floor of the container to support the inclined position of the lowest tray. The insert is advantageously roof-shaped and extends over approximately the entire bottom surface of the container. The insert can also comprise inclined slots in which the tray holders engage in the operational position.

Other objects, features and advantages of the present invention will be made apparent in the following detailed description of a preferred embodiment thereof provided with reference to the accompanying drawings.

DESCRIPTION OF THE PREFERRED EMBODIMENT

The transportation and display case according to the invention consists of two completely separable parts, more particularly, the actual display case 1 and a slide-on lid 2.

Figure 4:
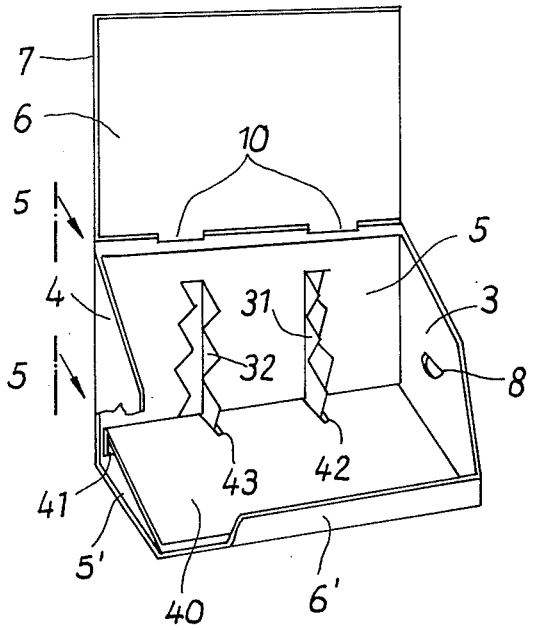
FIG. 4 is a detailed, partial sectional view of a display case with portions which have been partly cut away.
Figure 5:
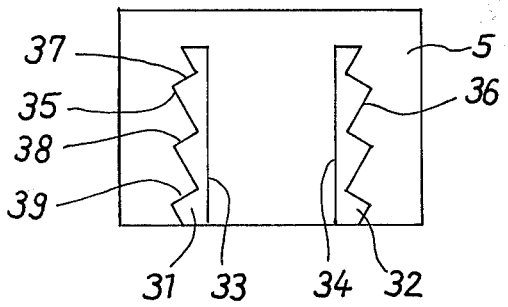
FIG. 5 is a view of the rear wall of the container along the line 5—5 in FIG. 4.

The display case which has a rectangular horizontal projection comprises side walls 3 and 4, a rear wall 5, a front wall 6, 6' and an upper wall 7 and also a bottom wall 5' (see FIG. 4). The two side walls 3 and 4 comprise openings 8. As stated, the front wall consists of two separable parts 6 and 6'. The latter is in the form of a strip and is rigidly connected to the side wall sections 3 and 4 and also to the bottom wall. The front wall part 6 is hinged to the upper wall part 7 and to double up the same in the display position it can be secured in such a way that the double wall section 6, 7 effectively forms an extension of the rear wall 5. The front wall part 6 comprises flaps 10 which can be used to secure it to the rear wall part.

The two side walls, the front wall, the upper wall and possibly the rear wall can all bear advertisements. Owing to the fact that the slide-on lid 2 completely covers the container 1 in the transporting position — as will be indicated hereinafter — the above-mentioned advertising surfaces which may be printed or provided with ornamentation are protected from damage during transportation.

In the embodiment represented, three trays 11 are mounted in the container in an inclined position. The trays are filled with adjacent pralines 12 which are arranged in rows and may be removed individually.

Figure 3:
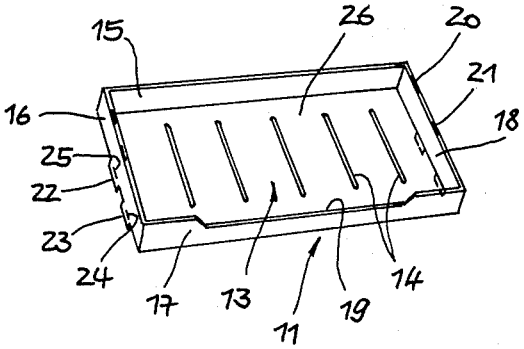
FIG. 3 is an oblique view of a tray to be used in the container.

As represented in FIG. 3, each tray comprises a bottom face 13 comprising longitudinal slots 14 and surrounding side walls 15, 16, 17 and 18 which are only approximately as high as the pralines. The side wall section 17 comprises a cut-away portion 19 to enable the tray to be gripped more easily.

The trays can be made of pasteboard in the same way as the container. Plastics material can also be used.

When pasteboard is used, the tray is preferably formed from a single blank.

The side wall parts 16 and 18 are preferably approximately ½–2cm. in width; they are provided on their upper side with longitudinal slots 20, 21 which are provided in the rear part of the side wall sections. On their underside the side wall sections are provided with flaps 22, 23. In this way it is possible to connect together the side wall sections in a staggered manner, thereby producing the stack assembly shown in FIG. 1 with the trays having the inclined position which will be described hereinafter. Corresponding slots and flaps are also provided in the side wall 16. The flaps 22, 23 are foldable about the fold lines 24, 25 and can be folded towards the bottom wall of the tray.

Th bottom wall 26 of the tray is smooth, thereby ensuring that the individual small articles such as pralines always slide down towards the front wall 17. The slidability of the pralines is increased by the longitudinal slot-like openings 14. These longitudinal slots follow the inclination of the inclined trays and also serve to position the inserted small articles. As the paper or plastic wrapping around the small articles is generally closed on their bottom surface, this uneven bottom surface is able to slide more easily owing to the slots 14.

Figure 2:
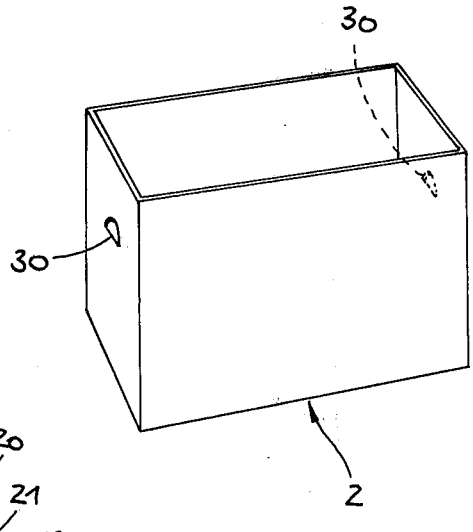
FIG. 2 is an oblique view of the slide-on lid for use when transporting the container.

The slide-on lid represented in FIG. 2 is rectangular and in the transporting position it covers the display case as far as its bottom wall. The slide-on lid is laterally provided with openings 30 which correspond in the operational position to the openings 8 in the display case, thus enabling the container to be gripped by these openings 30, 8 and carried.

The slide-on lid which may consist, for example, of corrugated paper can also be covered with advertisements and ornamentation. As may be noted from FIG. 1, the slide-on lid can also be used as a base support for the display case 1. The display case can obviously also be arranged on cabinets or shelves.

The rear wall comprises strips 31, 32 which can be swivelled in the manner of a window; the strips 31, 32 can be folded towards the inside of the container about the fold lines 33, 34. The strips 31, 32, which are symmetrical, each comprise a zig-zag edge 35, 36 which can be held at right angles to the rear wall-as will be described in greater detail hereinafter- to secure the inclined parts of the trays.

The edges 37, 38 and 39, which are parallel to one another, act as a support for a tray.

An insert 40 is disposed on the bottom wall; this insert consists of a flat blank corresponding approximately to the size of the bottom wall and of a strip 41 extending at right angles thereto. The insert 40, 41 comprises slots 42, 43 in the region of the two strips 31, 32. The strips 31, 32 are thus held at right angles to the rear wall 5 by the insert.

The roof-shaped insert 40 also forms a support for the lowest tray and thus acts as an inclined holder.

Figure 1:
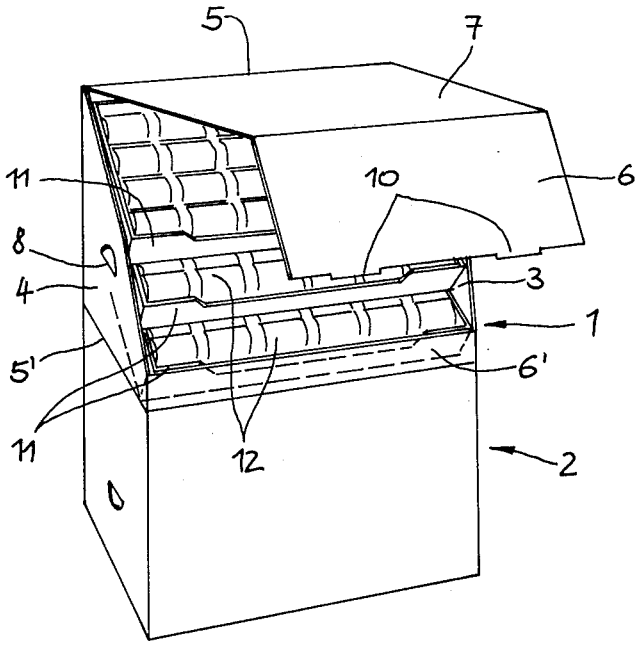
FIG. 1 is an oblique view of the container in the display position with the upper wall only partly let down.

As represented in FIG. 1, the trays are staggered with respect to one another and arranged directly above one another in an inclined position. As indicated above, they are connected together by the connecting parts 20 – 24.

The special configuration of the transportation and display case not only enables the transportation container to be converted very easily into a display case but the individual small articles are also ready for immediate sale as it is only necessary to double up the wall part 6, 7 and secure it to the rear wall 5.

What is claimed is:

1. A transportation and display case for holding individual small articles such as pralines which are stored on a plurality of levels, characterized in that the individual small articles are arranged adjacent to one another ready for removal on trays comprising at the upper and lower side of their side wall sections connecting parts which are staggered with respect to one another and adapted to be brought into engagement with one another and the rear wall of the container comprising mounting supports providing the individual trays with an inclined position.

2. A transportation and display case as claimed in claim 1, characterized in that the tray holders or supports consist of zig-zag-shaped strips which are pivotable from the rear wall towards the inside of the container.

3. A transportation and display case as claimed in claims 1, characterized in that the connecting parts consist of flaps, pins, or the like provided on the underside at the front part of the side wall sections and of slots, openings, or the like provided at the rear part of the side wall sections- or vice-versa.

4. A transportation and display case as claimed in claim 3, characterized in that the flaps or the like are foldable against the bottom wall of the trays.

5. A transportation and display case as claimed in claim 1, characterized in that the upper wall of the container may be folded back into the plane of the rear wall in a known manner.

6. A transportation and display case as claimed in claim 5, characterized in that the front wall or at least the larger part thereof is hinged to the upper wall and displaceable jointly with the latter.

7. A transportation and display case as claimed in claim 1, characterized in that the upper edges of the side wall sections of the container enclose an acute angle with respect to the bottom wall.

8. A transportation and display case as claimed in claim 1 the characterized in that the container may be covered in the transporting position with a slide-on lid extending to the bottom wall thereof.

9. A transportation and display case as claimed in claim 8 characterized in that the slide-on lid is rectangular in shape.

10. A transportation and display case as claimed in claim 8 characterized in that the slide-on lid and possibly the container are provided in corresponding positions with openings which enable staff to handle the container.

11. A transportation and display case as claimed in claim 1, characterized in that the trays are provided with grooves, longitudinal slots, or the like to enable the individual small articles to slide more easily.

12. A transportation and display case as claimed in claim 1, characterized in that an insert for supporting the inclined position of the lowest tray is provided on the bottom of the container.

13. A transportation and display case as claimed in claim 12, characterized in that the insert is roof-shaped and extends approximately over the entire bottom surface of the container.

14. A transportation and display case as claimed in claim 13, characterized in that the insert comprises inclined slots in which the tray holders engage in the operation position.

* * * * *